United States Patent [19]

Willingham

[11] 4,244,682

[45] Jan. 13, 1981

[54] PORTABLE CONCRETE MOLDING APPARATUS

[76] Inventor: John H. Willingham, 1280 Estate Dr., Memphis, Tenn. 38117

[21] Appl. No.: 77,408

[22] Filed: Sep. 20, 1979

[51] Int. Cl.[3] ..... B28B 15/00

[52] U.S. Cl. ..... 425/62; 249/161; 249/168; 425/88; 425/432

[58] Field of Search ..... 52/79.7; 425/62, 88; 249/50, 160, 161, 168, 169

[56] References Cited

U.S. PATENT DOCUMENTS

| | | | |
|---|---|---|---|
| 2,593,465 | 4/1952 | Le Tourneau | 425/62 X |
| 3,181,482 | 5/1965 | Heth et al. | 425/62 |
| 3,525,131 | 8/1970 | Schneider et al. | 425/62 X |
| 3,659,979 | 5/1972 | Schneider et al. | 425/62 |
| 4,004,874 | 1/1977 | Foster | 249/50 X |
| 4,136,492 | 1/1979 | Willingham | 52/79.7 |
| 4,207,041 | 6/1980 | Kampiziones | 425/62 |

*Primary Examiner*—J. Howard Flint, Jr.
*Attorney, Agent, or Firm*—Walker & McKenzie

[57] ABSTRACT

A portable concrete molding apparatus for use in casting concrete building components of particular shapes. The apparatus includes a trailer onto which is mounted three mold sections with one of the mold sections fixedly attached to the trailer and with the other two mold sections movably attached to the trailer.

33 Claims, 41 Drawing Figures

PORTABLE CONCRETE MOLDING APPARATUS

BACKGROUND OF THE INVENTION

1. Field of the Invention

This invention relates in general to means for molding concrete building elements and structures.

2. Description of the Prior Art

Heretofore, precast concrete building elements and structures have been molded and constructed in various manners. Willingham, U.S. Pat. No. 4,136,492 discloses various precast, generally T-shaped concrete building elements.

SUMMARY OF THE PRESENT INVENTION

The present invention is directed towards providing a portable apparatus for allowing concrete building elements and the like to be molded. The concept of the present invention is to fixedly attach a first mold means to a trailer and movably attach second and third mold means to the trailer so that the three mold means coact to form a mold for a building element or the like.

The molding apparatus of the present invention comprises, in general, a trailer including a bed; a first mold means for being fixedly attached to the bed; the first mold means including a first mold face having a forward edge, a rearward edge, a top edge, and a bottom edge; the first mold means also including a second mold face having an outer side edge, an inner side edge, a top edge and a bottom edge; the first and second mold faces of the first mold means being substantially normal to one another with a rearward edge of the first mold face being conterminous with the inner side edge of the second mold face; a second mold means for being movably attached to the bed; the second mold means including a first mold face having a forward edge, a rearward edge, a top edge and a bottom edge; the second mold means also including a second mold face having an outer side edge, an inner side edge, a top edge and a bottom edge; the first and second mold faces of the second mold means being substantially normal to one another with the rearward edge of the first mold face being conterminous with the inner side edge of the second mold face; the first mold faces of the first and second mold means being substantially the same shape and size and being located substantially directly opposite one another a spaced apart distance; and a third mold means for being movably attached to the bed; the third mold means including a first mold face having a first side edge; a second side edge, a top edge and a bottom edge; the first mold face of the third mold means being substantially the same shape and size as the combined spaced apart shape and size of the second mold faces of the first and second mold means and being located substantially directly opposite thereof a spaced apart distance.

DESCRIPTION OF THE PREFERRED EMBODIMENT

Figure 9:
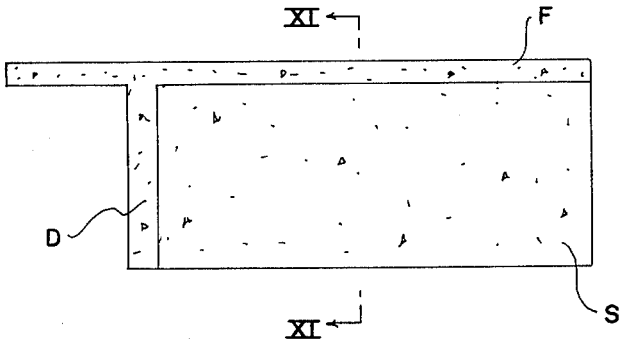
FIG. 9 is a side elevational view of a building element of the type molded by the molding apparatus of the present invention.
Figure 10:
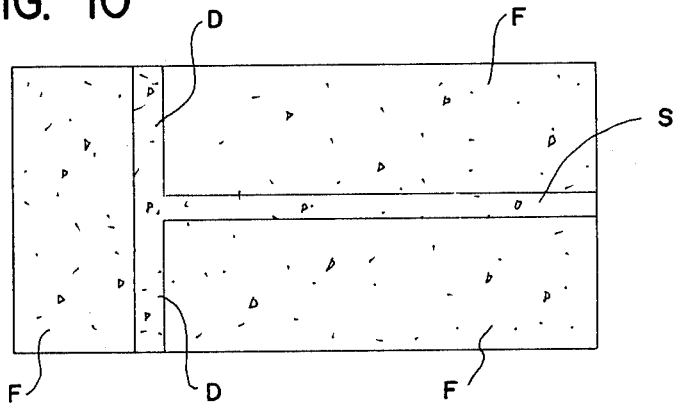
FIG. 10 is a bottom plan view of FIG. 9.
Figure 11:
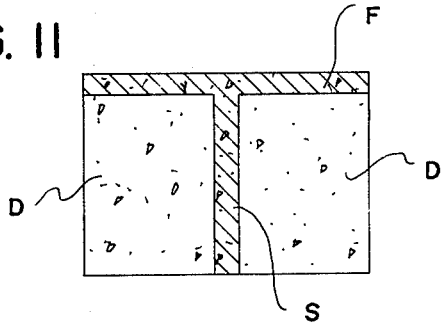
FIG. 11 is a sectional view as taken on line XI—XI of FIG. 9.

The molding apparatus 11 of the present invention is for use in the construction of precast building elements or structures such as disclosed in U.S. Pat. No. 4,136,492. Such building structures are basically T-shaped (referred to as "tees") but are subject to numerous modifications as disclosed in U.S. Pat. No. 4,136,492. The below description of the molding apparatus 11 will be directed primarily towards the construction of a "single diaphragm" tee (i.e., a tee having a stem S, a flange F and a diaphragm D as shown in FIGS. 9, 10 and 11). It will be apparent that the apparatus 11 can be easily used to mold other shapes such as a "double diaphragm" tee (i.e., a tee similar to the one shown in FIGS. 9, 10 and 11 but having a diaphragm D at both ends of the stem S rather than only at one end thereof).

Figure 1:
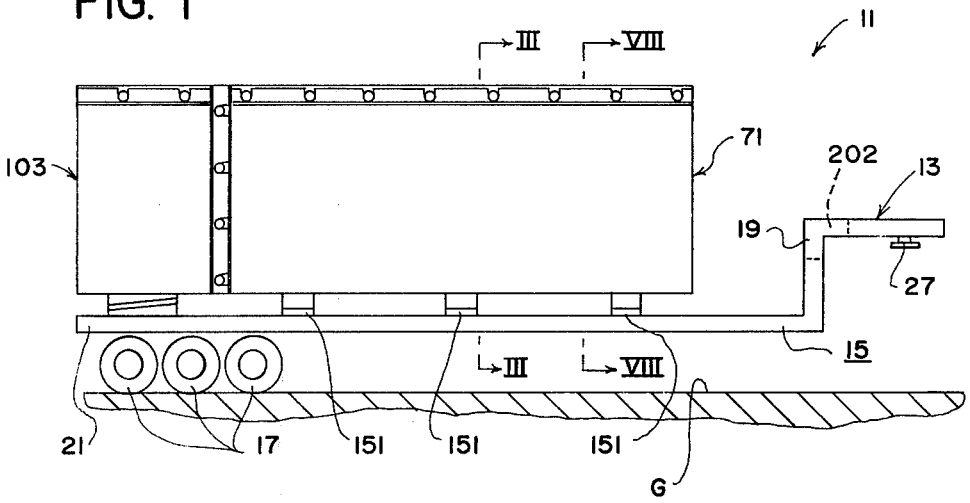
FIG. 1 is a somewhat diagrammatic side elevational view of the molding apparatus of the present invention with some parts thereof removed for clarity.
Figure 2:
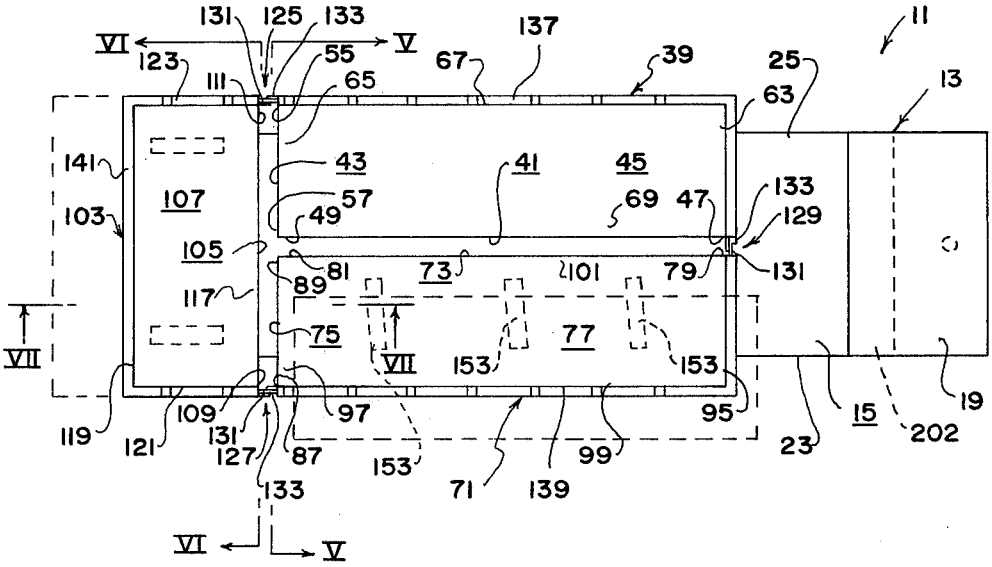
FIG. 2 is a top plan view of FIG. 1 with some parts shown in moved positions by broken lines.
Figure 3:
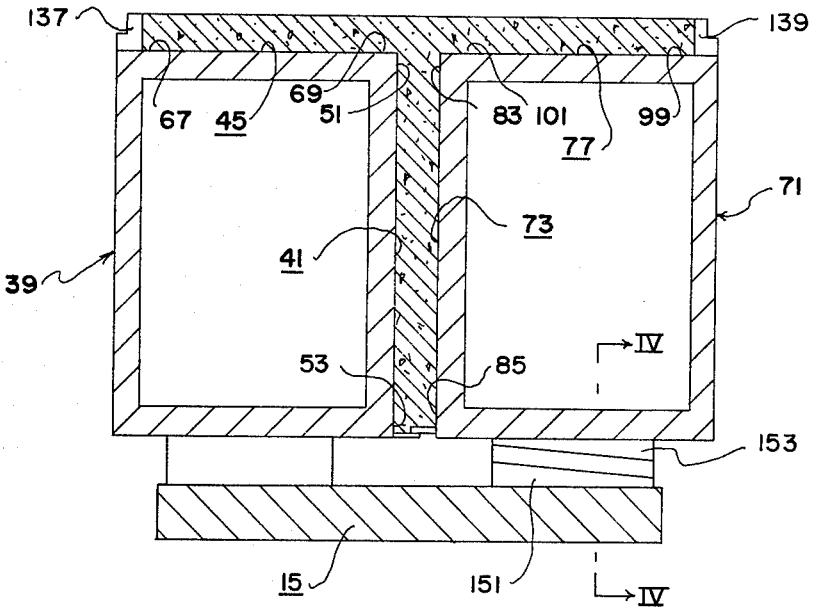
FIG. 3 is a sectional view as taken on line III—III of FIG. 1.

The molding apparatus 11 includes a trailer 13 substantially similar to the trailer of any well known tractor-trailer combination (see, in general, FIGS. 1 and 2). The trailer 13 includes a bed 15 and wheel means 17 for movably supporting the bed 15 above a supporting surface such as the ground G. The bed 15 includes a forward end 19, a rearward end 21, a first side 23, and a second side 25. The forward end 19 of the bed 15 may be provided with a typical hitch mechanism 27 for allowing the trailer 13 to be attached to a tractor or the like (not shown) in any manner apparent to those skilled in the art for allowing the trailer 13 to be moved.

Figure 33:
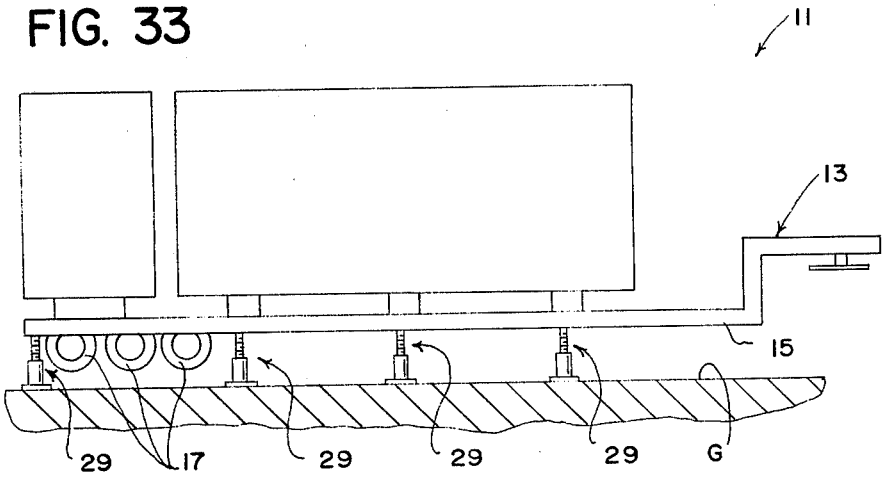
FIG. 33 is a side elevational view of the molding apparatus of the present invention, with some parts removed for clarity.
Figure 34:
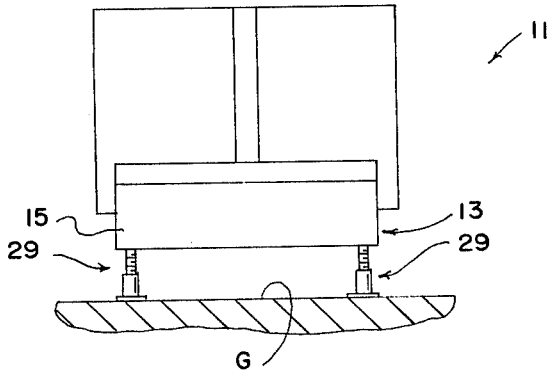
FIG. 34 is a front elevational view of FIG. 33.

A plurality of adjustable support means 29 may be located at spaced distances on the bed 15 for selectively extending between the bed 15 and the ground G to level and support the bed 15 (see FIGS. 33 and 34). The support means 29 may consist of typical jacks well known to those skilled in the art located on the outer end of the cross members (not shown) of the trailer 13. These jacks may be removably attached to the trailer 13 so that they can be removed completely therefrom and stored when the trailer 13 is being transported since, in some instances, there may not be sufficient ground clearance to allow transport of the trailer 13 over the normally rough terrain present on the job site. The specific construction and use of such jacks will be apparent to those skilled in the art.

Figure 35:
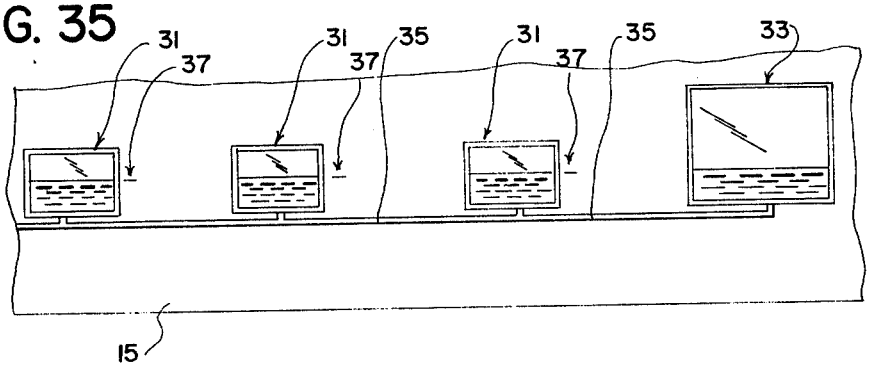
FIG. 35 is an elevational view of a portion of the molding apparatus of the present invention.

As an aid to the leveling process utilizing the support means 29, an interconnected series of level gauge means 31 may be attached to the bed 13 for indicating the degree of level of the bed 15 (see FIG. 35). Each level gauge means 31 may consist of a transparent and substantially vertical liquid container interconnected to a liquid reservoir 33 by way of hollow tubing 35 or the like. Calibration marks or indicia 37 are provided adjacent each level gauge means 31. In the leveling process the support means 29 are adjusted until the fluid level in each level gauge means 31 has the same relationship to the calibration marks 37. Since by nature the fluid surfaces in the gauge means 31 will be coplaner, the calibration marks 37, and therefore the bed 15, will also be coplaner and level.

The molding apparatus 11 includes a first mold means 39 for being fixedly attached to the bed 15 (see, in general, FIGS. 2, 3, 5 and 6). The first mold means 39 includes a first mold face 41 and a second mold face 43. The first mold means 39 preferably also includes a third mold face 45. Each mold face 41, 43, 45 is substantially flat. The first mold face 41 has a forward edge 47, a rearward edge 49, a top edge 51 and a bottom edge 53. The second mold face 43 has an outer side edge 55, an inner side edge 57, a top edge 59, and a bottom edge 61. The third mold face 45 has a forward edge 63, a rearward edge 65, an outer side edge 67, and an inner side edge 69. The first and second mold faces 41, 43 are substantially normal to one another with the rearward edge 49 of the first mold face 41 being conterminous with the inner side edge 57 of the second mold face 43. The third mold face 45 is substantially normal to the first and second mold faces 41, 43 with the inner side edge 69 thereof being conterminous with the top edge 59 of the second mold face 43. The first mold means 39 is preferably in the form of a hollow, regular hexahedron.

The molding apparatus 11 includes a second mold means 71 for being movably attached to the bed 15 (see, in general, FIGS. 1, 2, 3, 5 and 6). The second mold means 71 includes a first mold face 73 and a second mold face 75. Preferably, the second mold means 71 also includes a third mold face 77. The first mold face 73 has a forward edge 79, a rearward edge 81, a top edge 83, and a bottom edge 85. The second mold face 75 has an outer side edge 87, an inner side edge 89, a top edge 91, and a bottom edge 93. The third mold face 77 has a forward edge 95, a rearward edge 97, an outer side edge 99, and an inner side edge 101. The first and second faces 73, 75 are substantially normal to one another with the rearward edge 81 of the first mold face 73 being conterminous with the inner side edge 89 of the second mold face 75. The third mold face 77 of the second mold means 71 is substantially normal to the first and second mold faces 73, 75 thereof with the inner side edge 101 of the third mold face 77 being conterminous with the top edge 83 of the first mold face 73 and with the rearward edge 97 of the third mold face 77 being conterminous with the top edge 91 of the second mold face 75. The first mold faces 41, 73 of the first and second means 39, 71 are substantially the same shape and size and are located substantially directly opposite one another a spaced apart distance. The second mold means 71 preferably consists of a hollow, regular hexahedron.

The molding apparatus 11 includes a third mold means 103 for being movably attached to the bed 15 (see, in general, FIGS. 1, 2, 6 and 7). The third means 103 includes a first mold face 105 and preferably includes a second mold face 107. The first mold face 105 has a first side edge 109, a second side edge 111, a top edge 113, and a bottom edge 115. The second mold face 107 has a forward edge 117, a rearward edge 119, a first side edge 121 and a second side edge 123. The first and second mold faces 105, 107 of the third mold means 103 are substantially normal to one another with the forward edge 117 of the second mold face 107 being conterminous with the top edge 113 of the first mold face 105. The first mold face 105 of the third mold means 103 is substantially the same shape and size as the combined spaced apart shape and size of the second mold faces 43, 75 of the first and second mold means 39, 71 and is located substantially directly opposite thereof a spaced apart distance. The third mold means 103 preferably consist of a hollow, regular hexahedron.

The molding apparatus 11 preferably includes a first dam means 125 for selectively extending between the second side edge 111 of the first mold face 105 of the third mold means 103 and the outer side edge 55 of the second mold face 43 of the first mold means 39; preferably includes a second dam means 127 for selectively extending between the first side edge 109 of the first mold face 105 of the third mold means 103 and the outer side edge 87 of the second mold face 75 of the second mold means 77; and preferably includes a third dam means 129 for selectively extending between the forward edges 47, 79 of the first mold faces 41, 73 of the first and second mold means 39, 71 (see, in general, FIG. 2). Each dam means 125, 127, 129 includes a first elongated flange member 131 attached to one mold means 39, 71, 103 and includes a second elongated flange member 133 attached to another of the mold means 39, 71, 103 for coacting with the first flange member 131 (see, in general, FIG. 2). Dam means 125, 127, 129 are utilized to substantially close off the ends of various mold cavities formed by the interaction of the first, second and third mold means 39, 71, 103.

Figure 12:
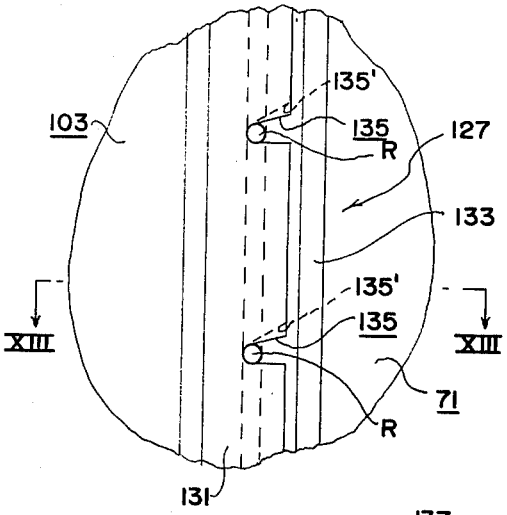
FIG. 12 is an elevational view of a portion of the molding apparatus of the present invention.
Figure 13:
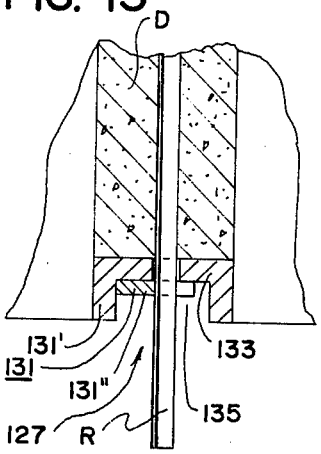
FIG. 13 is a sectional view as taken on line XIII—XIII of FIG. 12.

The dam means 125, 127 may be adapted to allow metal reinforcing rods R or the like to extend therethrough while substantially closing off the space between the adjacent mold means. One manner in which the dam means 125, 127 may be adapted to allow reinforcing rods R to protrude therethrough is to arrange portions of the flange members 131, 133 thereof so that they will overlap one another when the mold means 71, 103 are in a closed position as will be hereinafter explained and by providing one of the flange members 131, 133 with a plurality of spaced, outwardly opening notches 135 for allowing the reinforcing rods R to extend therethrough so that the flange members 131, 133 will coact to substantially block all of the notches 135 except the portion thereof which the reinforcing rods R extend through (see, for example, the dam means 127 in FIGS. 12 and 13). The notches 135 are preferably substantially V-shaped for reasons which will hereinafter be explained. It should be noted that each flange member 131, 133 may be of an integral, one-piece construction or may be of a built-up construction as will be apparent to those skilled in the art. Thus, the flange member 131 is shown in FIG. 13 as being of a built-up construction including a first member 131' that is substantially a mirror image of the flange member 133 for coacting with the flange member 131 to form a substantially straight dam face, and includes a second member 131" attached to the first member 131' and overlapping a portion of the flange member 133. The notches 135 are provided in the second member 131".

Figure 8:
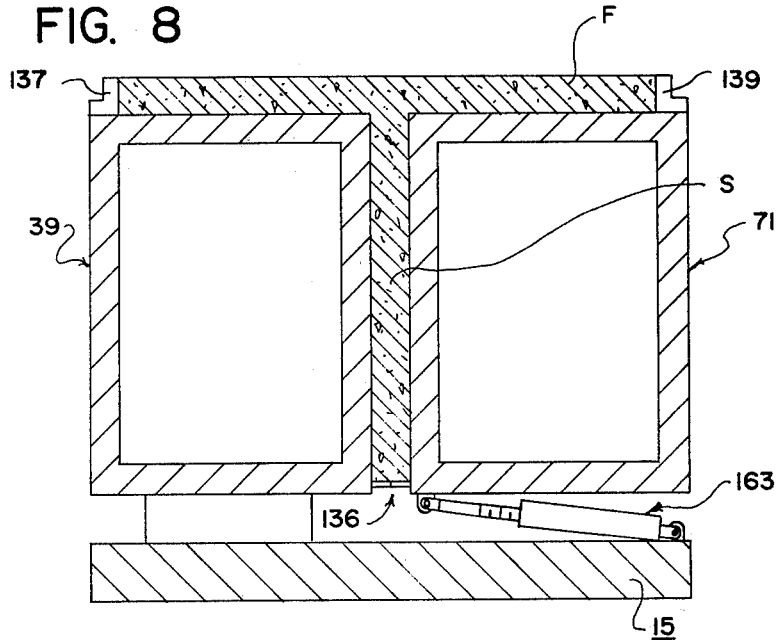
FIG. 8 is a sectional view as taken on line VIII—VIII of FIG. 1.

The molding apparatus 11 may include a fourth dam means 136 (see, in general, FIGS. 7 and 8) for extending between the bottom edges of the mold faces 41, 43, 73, 75, 105 of the mold means 39, 71, 103 to substantially close off the bottom edges thereof when the mold means 71, 103 are in the closed position. The dam means 136 may be substantially similar to the dam means 125, 127, 129 in both construction and operation and the above description should suffice.

Figure 14:
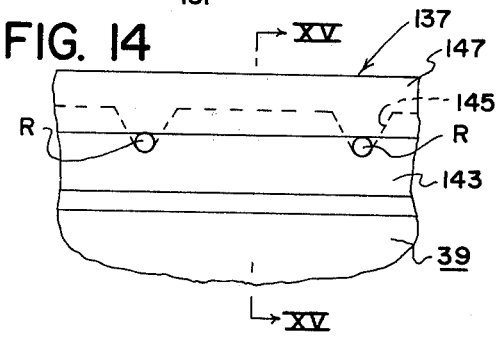
FIG. 14 is an elevational view of a portion of the molding apparatus of the present invention.
Figure 15:
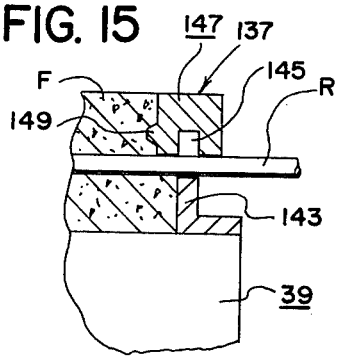
FIG. 15 is a sectional view as taken on line XV—XV of FIG. 14.

The first mold means 39 preferably includes a rail means 137 for extending upward from the forward edge 63 and the outer side edge 67 of the third mold face 45 thereof (see, in general, FIG. 2). The second mold means 81 preferably includes a rail means 139 for extending upward from the forward edge 95 and the outer side edge 99 of the third mold face 77 thereof (see, in general, FIG. 2). The third mold means 103 preferably includes a rail means 141 for extending upward from the rearward edge 119, first side edge 121, and second side edge 123 of the second mold face 107 thereof (see, in general, FIG. 2). Each rail means 137, 139, 141 preferably includes an upwardly directed, elongated flange member 143 (see, in general, the detailed showings of the rail means 137 in FIGS. 14 and 15). A plurality of spaced apart notches 145 may be provided in certain portions of the flange members 143 for allowing metal reinforcing rods R or the like to extend therethrough. Each rail means 137, 139, 141 may include an elongated cap member 147 for coacting with the flange members 143 to substantially block all of the notches 145 except the portions thereof which the reinforcing rods R extend through (see, in general, the detailed showings of the rail means 137 in FIGS. 14 and 15). The cap members 147 are preferably substantially inverted U-shaped in cross section. The inner face of each cap member 147 may be provided with an elongated boss-like portion 149 (see FIG. 15) to form a keyseat in the edge of the flange F of the tee. The notches 145 may be substantially V-shaped for reasons which will hereinafter be explained. The top of the cap members 147 control the thickness of the flange F as will now be apparent to those skilled in the art.

Figure 4:
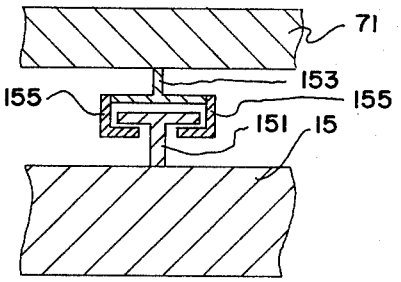
FIG. 4 is a sectional view as taken on line IV—IV of FIG. 3.
Figure 5:
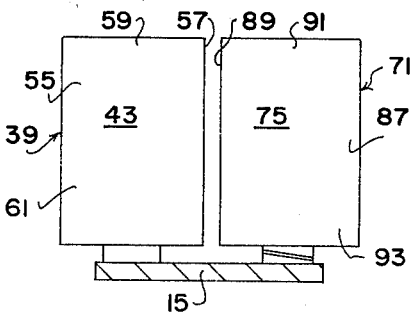
FIG. 5 is a sectional view as taken on line V—V of FIG. 2.
Figure 6:
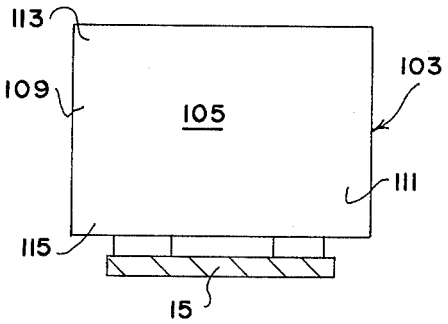
FIG. 6 is a sectional view as taken on line VI—VI of FIG. 2.
Figure 7:
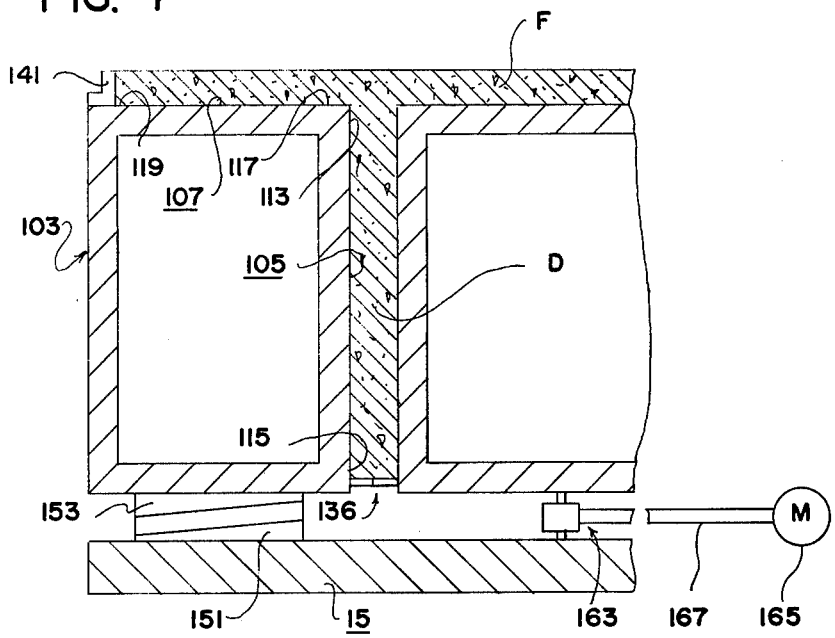
FIG. 7 is a sectional view as taken on line VII—VII of FIG. 2.

The molding apparatus 11 preferably includes a first transit means for allowing the second mold means 71 to move between opened and closed positions and preferably includes a second transit means for allowing the third mold means 103 to move between opened and closed positions. The first transit means may include a first slide means for being attached to the bed 15, a second slide means for being attached to the second mold means 71 and for coactingly engaging the first slide means thereof, and an actuator means for causing the second mold means to move between the open and closed positions. The second transit means may also include a first slide means for being attached to the bed 15, a second slide means for being attached to the third mold means 103 and for coactingly engaging the first slide means thereof, and an actuator means for causing the third mold means to move between the opened and closed positions. The first slide means of the first and second transit means preferably includes a plurality of elongated slide members 151 for being attached to the bed 15 in any manner apparent to those skilled in the art such as by being bolted thereto (not shown). Each slide member 151 is preferably substantially T-shaped in cross section (see, in general, FIG. 4). The second slide means of the first and second transit means preferably includes a plurality of slide members 153 for being fixedly attached to the bottom of the second mold means 71 and the third mold means 103, respectfully, in any manner apparent to those skilled in the art such as by being bolted thereto (not shown). The slide members 153 are preferably substantially inverted T-shaped in cross section (see, in general, FIG. 4). The second slide means of the first and second transit means also preferably includes a hook clip means 155 attached to the opposite edges of each slide member 153 thereof for aligning and holding each slide member 153 with respect to a coacting one of the plurality of slide members 151 (see, in general, FIG. 4). The slide members 151, 153 preferably slope downward and outward with respect to the first mold means 39 (see, in general, FIGS. 3 and 7) to cause the second and third mold means 71, 103 to move downward and outward with respect to the first mold means 39 when the second and third mold means 71, 103 are moved from the closed position to the opened position. The slide members 151, 153 of the first transit means preferably angle forwardly as they extend outwardly of the first mold means 39 (see, in general, FIG. 2) to cause the second mold means 71 to move forward with respect to the third mold means 103 when the second mold means 71 is moved from the closed position to the opened position.

Figure 23:
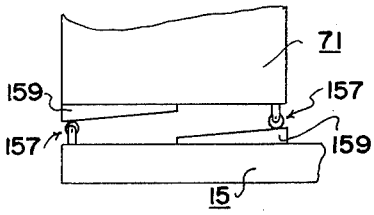
Figure 24:
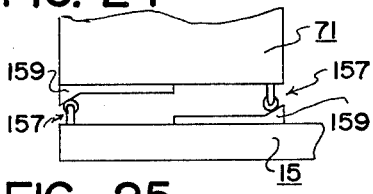
Figure 25:
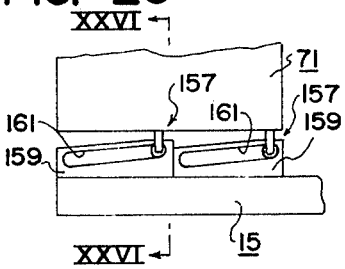
Figure 26:
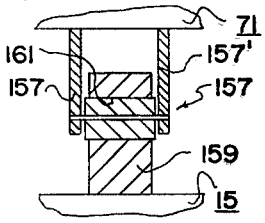
FIG. 26 is a sectional view as taken on line XXVI—XXVI of FIG. 25.

The first and second transit means may consist of various alternate constructions as shown in FIGS. 21–26. Thus, rather than having the slide members 151, 153, the first and second transit means may include a plurality of roller means 157 and a plurality of roller follower means 159 for coactingly engaging the roller means 157. Each roller follower means 159 may have an elongated slot 161 (see FIGS. 25 and 26) therein for receiving a portion of the coacting roller means 157 and for aligning and holding the roller means 157 with respect to the roller follower means 159. The slot 161 will provide a means to resist any upthrust forces of the mold means. The roller means 157 may include yoke plates 157' which project on either side of the followr means 159 as shown in FIG. 26 to limit lateral movement of the roller means 157. The slot 161 preferably extends downwardly and outwardly with respect to the first mold means 39 to cause the second and third mold means 71, 103 to move downward and outward with respect to the first mold means 39 when the second and third mold means 39, 103 are moved from the closed position to the opened position. The roller follower means 159 is shown split into two sections in FIGS. 22–25. This provides for a reduction in height of the transit means without compromising slide motion. The overall height of the molding apparatus 11 may become important in transport because of bridge and viaduct height restrictions. FIGS. 23 and 24 shows a modification of the split follower means construction in which one of the sections of the roller follower means 159 and an associate roller means 157 are inverted. This results in increased stability of the movable mold means when in the closed position because of the increased spread between roller contact points. FIG. 24 shows an arrangement in which the up-down travel caused thereby is made to occur during a relatively small portion of the in-out travel of the movable mold means rather than being substantially directly proportional to such in-out travel as in the structures of FIGS. 21, 22, 23 and 25.

The purpose of moving the second and third mold means 71, 103 downward and outward with respect to the first mold means 39, etc., is that in opening the molding apparatus 11, provisions should be made to allow the mold faces thereof to release the part cast as quickly as possible to prevent damage to either the part cast or the molding apparatus 11 by virture of interference between the two. Thus, by causing the third mold means 103 to move rearwardly at a downward angle of 3° or the like, the mold faces 105, 107 thereof will immediately release the part cast. Likewise, by causing the second mold means 71 to move outward at a downward angle of 3° or the like and forward at an outward angle of 3° or the like, the mold faces 73, 75, 77 thereof will immediately release the part cast. The V-shaped notches 135, 145 of the dam means 125, 127 and the rail means 137, 139, 141 should be sized so as not to hinder angular movement of the mold means 71, 103. Thus, the angle of the upper wall of the notches 135 should be slightly greater than the angular movement of the mold means 71, 103. The opening of the mold means 71, 103 will further be facilitated if the inner faces of the slots 135 have a slight angle to them. This is represented by the dotted lines 135' in FIG. 12.

Figure 17:
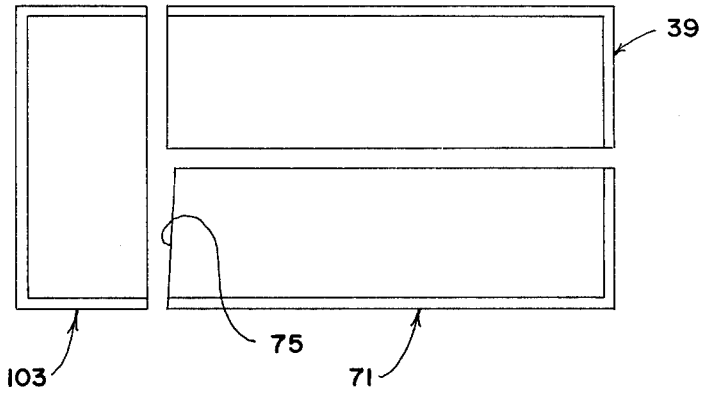
FIG. 17 is a somewhat diagrammatic top plan view of a portion of a modified embodiment of the molding apparatus of the present invention.
Figure 18:
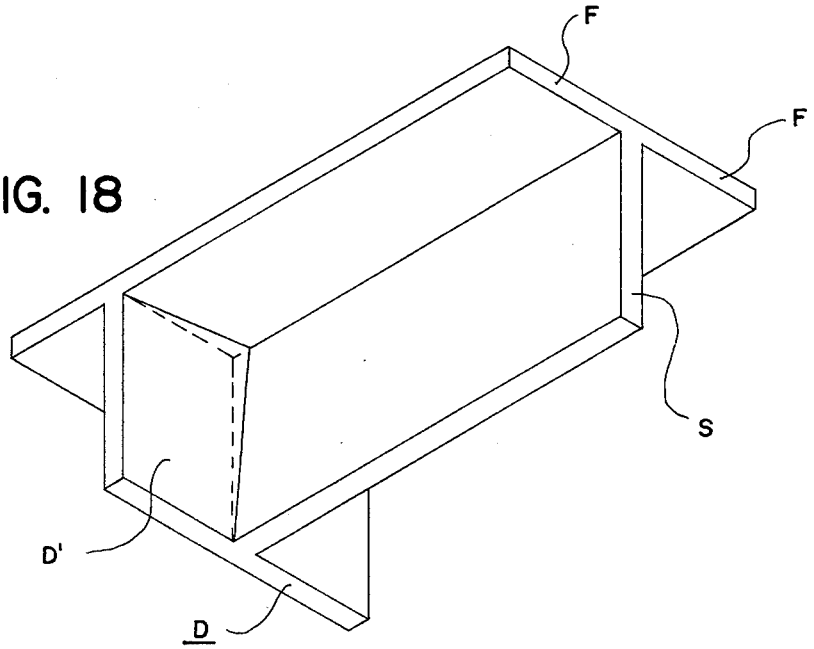
FIG. 18 is a pictorial view of a building element of the type molded by the molding apparatus of FIG. 17.

There are alternate methods of accomplishing the above. For example, the mold faces themselves may be made on an angle. Thus, in FIG. 17, the second mold face 75 of the second mold means 71 is displaced at an angle on the order of 3° so that when the mold means 71 is moved outward, the mold face 75 will immediately release the part cast. Such a construction will, of course, produce a part similar to that shown in FIG. 18 in which a portion D' of the diaphragm D thereof corresponds to the angular displacement of the mold face 75.

Figure 19:
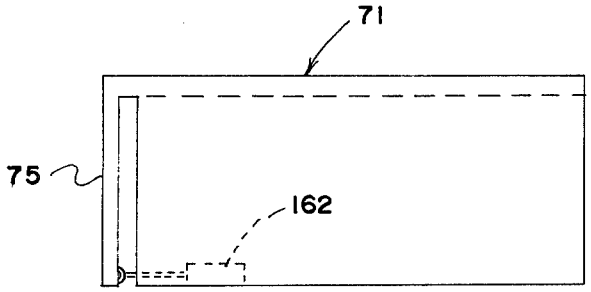
FIG. 19 is an elevational view of a portion of another modified embodiment of the molding apparatus of the present invention.
Figure 20:
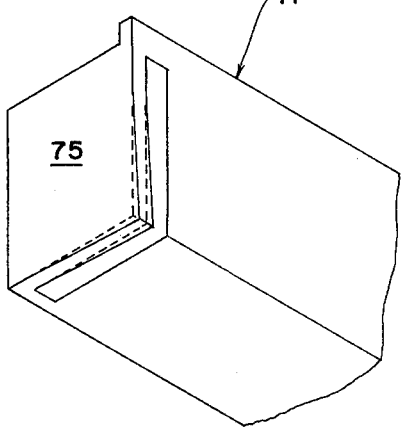
FIG. 20 is a pictorial view of a portion of the molding apparatus of FIG. 19.
Figure 21:
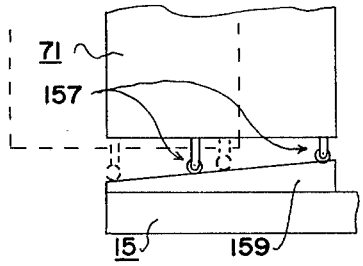
FIGS. 21–25 are diagrammatic views of alternate embodiments of a portion of the molding apparatus of the present invention.
Figure 22:
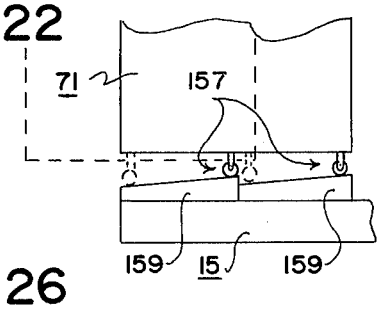

FIGS. 19 and 20 shows yet another method of accomplishing the above. More specifically, FIGS. 19 and 20 represent a modified second mold means 71 in which the mold face 75 thereof can be moved by way of a piston 162 (see FIG. 19) from a non-deformed position (shown in solid lines in FIG. 19 and in broken lines in FIG. 20) to a deformed position (shown in solid lines in FIG. 20). Thus, when the part is being cast, the mold face 75 is held in the non-deformed position. When it is desired to move the mold means 71 to the open position, the mold face 75 is moved to the deformed position so that the mold face 75 will immediately release the part cast upon outward movement of the mold means 71.

The actuator means of the first and second transit means may consist of air or hydraulic cylinders well known to those skilled in the art. Preferably, the actuator means includes a plurality of well known jack screw means 163 positioned at spaced apart positions along the length of the second and third mold means 71, 103 and includes a motor means 165 coupled to the plurality of jack screw means 163 by appropriate shafts 167 for driving the plurality of jack screw means 163 in any manner apparent to those skilled in the art (see, in general, FIGS. 7 and 8) to thereby move the second and third mold means 71, 103 between the opened and closed positions.

Figure 27:
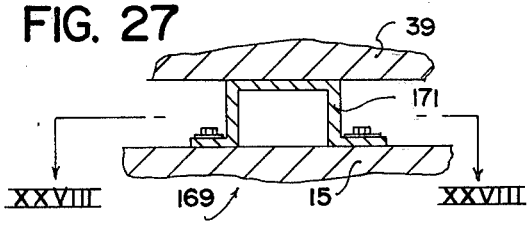
FIG. 27 is a sectional view of a portion of the molding apparatus of the present invention.
Figure 28:
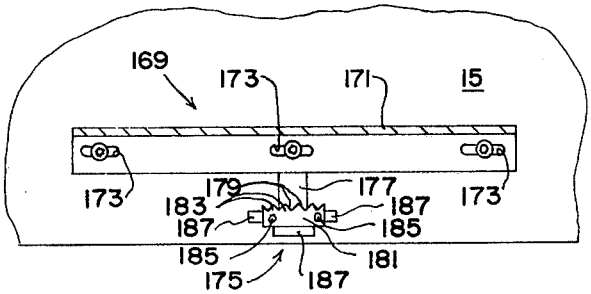
FIG. 28 is a sectional view as taken on line XXVIII—XXVIII of FIG. 27.
Figure 29:
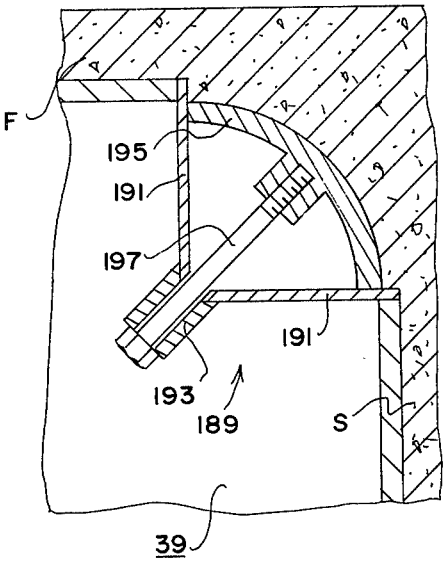
FIGS. 29–32 are sectional views of alternate embodiments of a portion of the molding apparatus of the present invention.
Figure 31:
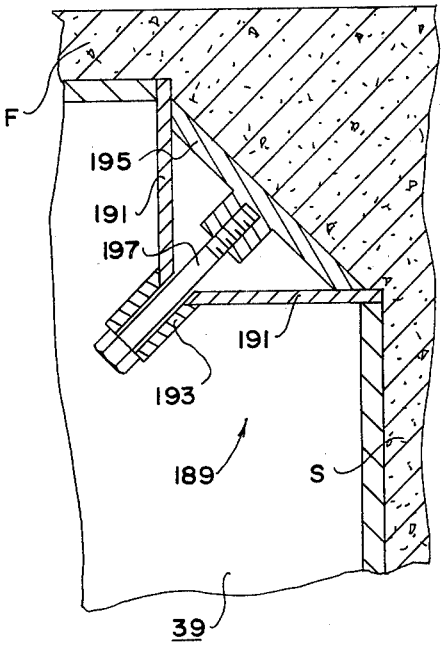
Figure 32:
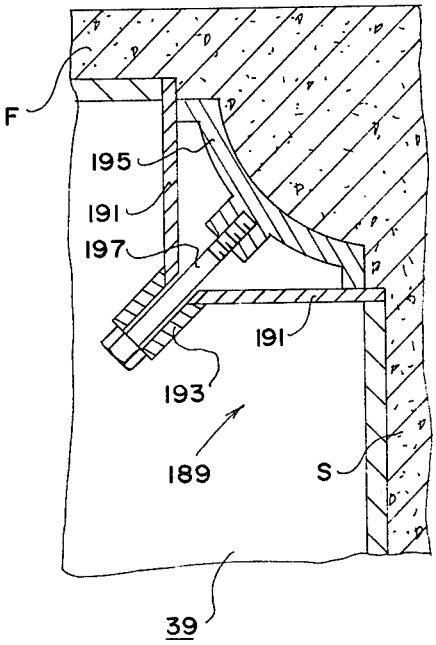

The molding apparatus 11 preferably includes adjustment means 169 (see, in general, FIGS. 27 and 28) for allowing adjustments of the mold means 39, 71, 103 with respect to one another to allow thicker or thinner tees to be molded. Thus, the molding apparatus 11 includes one adjustment means 169 (shown in FIGS. 27 and 28) for allowing the first mold face 41 of the first mold means 39 to be selectively moved inward and outward, includes another adjustment means 169 (not shown) for allowing the first mold face 73 of the second mold means 71 to be selectively moved inward and outward, and includes yet another adjustment means 169 (not shown) for allowing the first mold face 105 of the third mold means 103 to be selectively moved forward and rearward. Each adjustment means 169 may include a slide member 171 fixedly attached to the body of the respective mold means 39, 71, 103 in any manner apparent to those skilled in the art such as by being bolted thereto (not shown). Each slide member 171 is also bolted to the bed 15 through slots 173 in the slide member 171 to thereby allow selective movement of the respective mold means 39, 71, 103 along the slots 173 in a manner which should now be apparent to those skilled in the art. Each adjustment means 169 may be provided with a lock means 175 (see FIG. 28) to insure that the adjustments once made are maintained. Each lock means 175 may include a block 177 fixedly attached to the slide member 171 by welding or the like and having serrations or teeth 179 along the outer edge thereof. A coacting block 181 having serrations or teeth 183 for engaging the teeth 179 of the block 177 is removably attached to the bed 15 by bolts 185 or the like. Blocks 187 are welded to the bed 15 closely adjacent the block 181 to prevent lateral movement of the block 191. The coacting teeth 179, 183 of the blocks 177, 181 will coact to prevent lateral movement of the slide members 171. To allow movement of the slide member 171, the bolts 185 are loosened to allow the block 181 to be removed from the bed 15. Next, the bolts holding the slide member 171 to the bed 15 are loosened to allow the slide member 15 to be slid along the bed 15 by manual force or the like. The bolts holding the slide member 171 to the bed 15 can then be retightened and the block 181 can then be repositioned with the teeth 183 engaging the teeth 179 so as to lock the slide member 171 in position.

Figure 30:
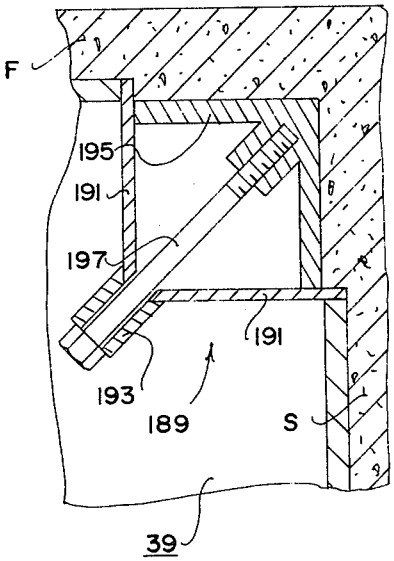
Figure 30A:
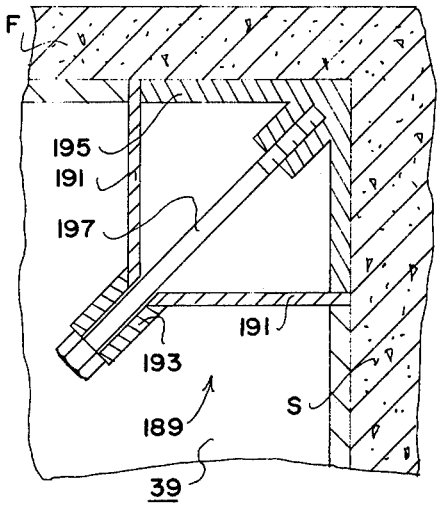
Figure 30B:
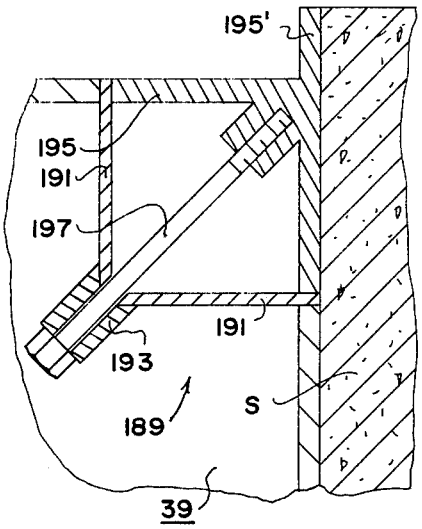

Each mold means 39, 71, 103 may include an adjustable means 189 (see, in general, FIGS. 29–32) for allowing a cove or the like to be formed along the intersection between the flange F and the stem S or diaphragm D of the tee. Thus, the molding apparatus 11 may include an adjustable means 189 along the rearward edge 49 of the first mold face 41 and along the top edge 59 of the second mold face 43 of the first mold means 39 (see FIGS. 29–32); may include an adjustable means 189 along the rearward edge 81 of the first mold face 73 and along the top edge 91 of the second mold face 75 of the second mold means 71 (not shown); and may include an adjustable means 189 along the top edge 113 of the first mold face 105 of the third mold means 103 (not shown). Each mold means 39, 73, 103 is provided with an offset portion 191 adjacent the edges where the adjustable means 189 is located for receiving the adjustable means 189. Each adjustable means 189 includes a plurality of threaded bosses 193 attached to the offset portion 191 of the respective mold means 39, 71, 103. Each means 189 further includes an elongated form 195 for being removably attached to the bosses 193 by way of bolts 197 or the like. The form 195 may be of various shapes as shown in FIGS. 29–32. The forms 195 shown in FIGS. 29, 30, 31, 32 will result in various cove-like shapes in each intersection as clearly shown in the drawings. The form 195′shown in FIG. 30A will result in a square, perpendicular intersection as clearly shown in the drawing. The form 195 shown in FIG. 30B has an upwardly extending appendage 195′ which acts in a manner similar to the rail means 137, 139,141 to form one outer side of the building structure being molded (the building structure will then be substantially L-shaped in cross section rather than substantially T-shaped).

Figure 16:
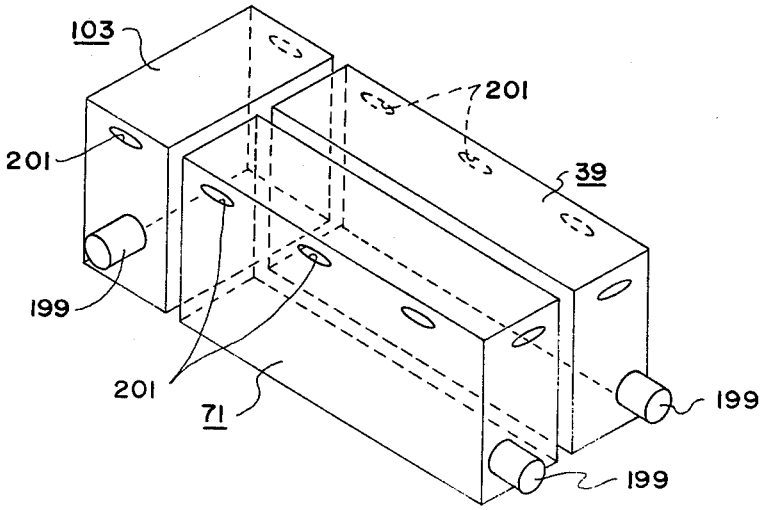
FIG. 16 is a somewhat diagrammatic pictorial view of a portion of the molding apparatus of the present invention.

The molding apparatus 11 may include means for selectively heating the first, second and third mold means 39, 71, 103 to shorten cure time and to permit the casting of parts during weather which would normally render operations impossible (e.g., when the temperature is below about 40° F.). It has been found that if the mold means 39, 71, 103 can be heated to approximately 200° F., the cast concrete part can be handled in about four hours. Without heating, cure time to handling may be a matter of days or weeks. The heating means may incorporate electrical resistance heating (e.g., heating wires, well known to those skilled in the art, may be embedded in the mold faces). Preferably, the heating means utilizes hot air produced by fan-forced tubular-type oil or gas fired heaters 199 associated with each mold means 29, 71, 103 for causing hot air to be circulated within the interior cavity of each mold means 39, 71, 103 (see, in general, FIG. 16). A single heater 199 of proper size will be sufficient but more even operation may be obtained by using two or more heaters 199. Heated air will flow from the heaters 199 into the interior of the mold means 39, 71, 103, circulated throughout the interior thereof, and eventually escape through vents 201 in the mold means 39, 71, 103. The heaters 199 may be thermostatically controlled by sensing temperatures with suitable well known elements (not shown) located in the mold faces. The molding apparatus 11 may include a fuel tank 202 for supplying fuel to the heaters 199. The fuel tank 202 may be located within the goose-neck portion of the bed 15 (see FIGS. 1 and 2) and connected to the heaters 199 by suitable tubing or the like (not shown).

Figure 36:
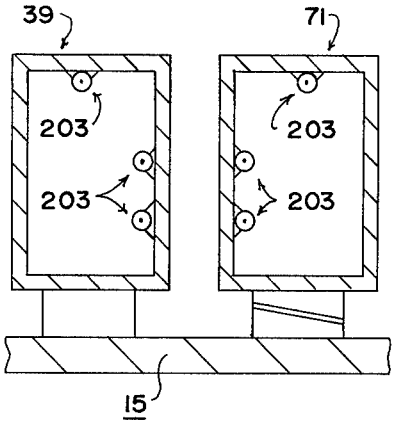
FIG. 36 is a sectional view similar to FIG. 3.
Figure 37:
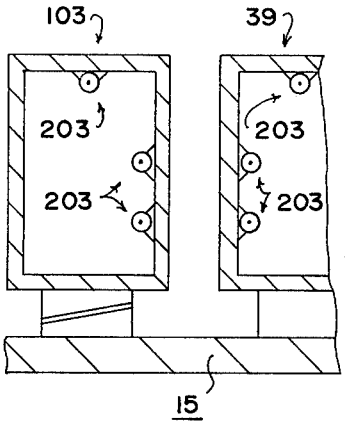
FIG. 37 is a sectional view similar to FIG. 7.

The molding apparatus 11 may include vibrator means for selectively vibrating the first, second and third mold means 39, 71, 103 during pouring operations to facilitate the concrete placement in the molding apparatus 11. The vibrator means may include a plurality of well-known eccentric-weight type motor driven vibrator means 203 coupled at intervals (e.g., at about five foot intervals along the length of each mold means 39, 71, 103) to the back sides of the mold faces of the first, second and third mold means 39, 71, 103 (see, e.g., FIGS. 36 and 37).

Figure 38:
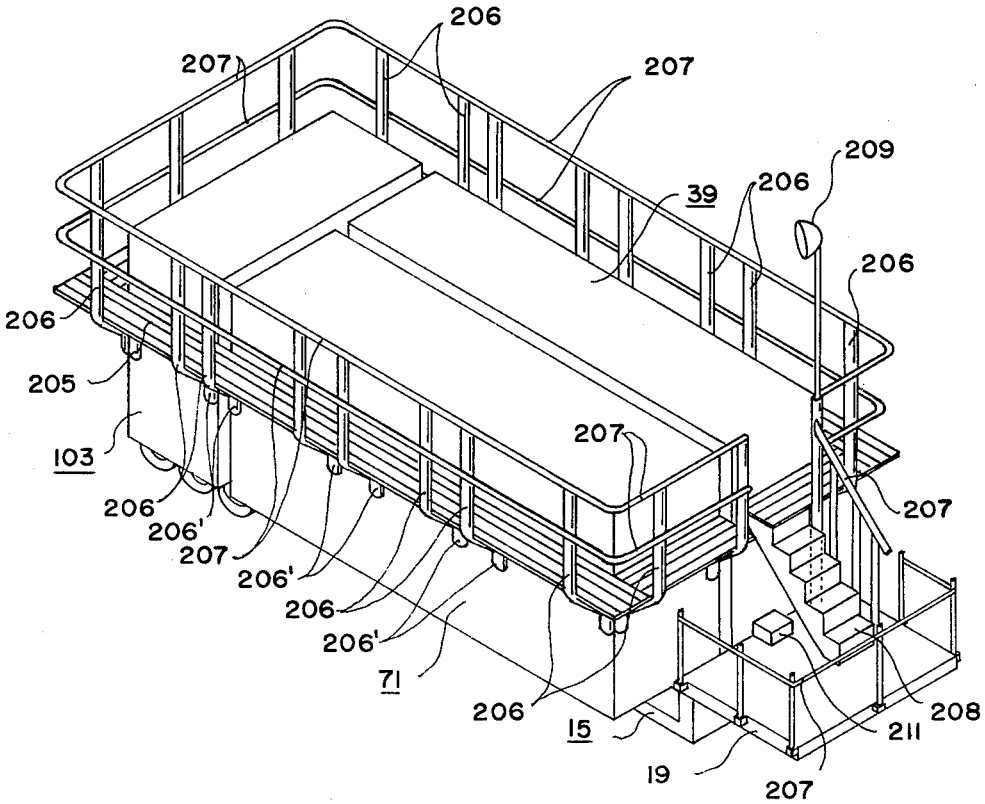
FIG. 38 is a pictorial view of the molding apparatus of the present invention with some parts removed for clarity.
Figure 39:
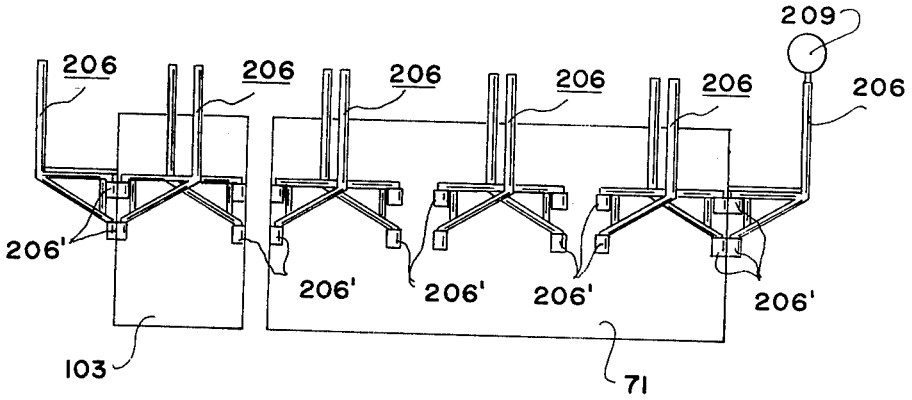
FIG. 39 is a somewhat diagrammatic side elevational view of portions of the present invention.

The molding apparatus 11 may include a walkway 205 (see FIGS. 38 and 39) for surrounding the first, second and third mold means 39, 71, 103 to aid in pouring and finishing operations on the top portion of the apparatus 11. The walkway 205 may consist of support brackets 206 that fit into sockets 206′ or the like attached at spaced intervals to the outer sides of the mold means 39, 71, 103. Planking or the like is laid over the brackets 206. A safety rail means 207 (see FIG. 38) may be provided around the walkway means 205. Permanent stairs 208 may be located on the forward end 19 of the bed 15 for leading to the walkway means 205. The safety rail means 207 preferably extends down the stairs 208 and around a portion of the formal end 19 of the bed 15 as shown in FIG. 38. Removable and telescopic light means 209 (see FIG. 28) may be attached to the walkway means 205 at various positions (e.g., at the intersection between the walkway means 205 and the stairs 208 where it will illuminate the space between the mold means 29, 71). The walkway means 205 and light means 209 are preferably adapted to be moved to closed positions as shown in FIG. 39 to allow the molding apparatus 11 to be easily transported. To accomplish this, the planking and portions of the safety rail means 207 are removed from the brackets 206 and stored on top of the mold means 39, 71, 103 and the brackets 206 on the sides and rear of the apparatus 11 can be rotated to lie substantially flat against the sides of the mold means 39, 71, 103. Adjacent brackets 206 may be folded over one another and tied together to hold them in the closed position when being transported. The light means 209 is lowered to a closed position as shown in FIG. 39 when the apparatus 11 is to be transported.

The molding apparatus 11 may include a generator 211 for powering all various electrical components (e.g., the vibrator members 203, the light means 209, heating means 199, and actuation systems 163). The generator 211 may be located on the forward end 19 of the bed 15 (see, in general, FIG. 38).

The preferred method of operation of the molding apparatus 11 is, in general, as follows:

The trailer 13 is moved to the construction site and leveled using the movable support means 29 and level gauge means 31. With the second and third mold means 71, 103 in the closed position, the mold means 39, 71, 103 are adjusted relative to one another by way of the adjustment means 169 to produce a tee having a flange F and diaphragm D of a desired thickness. Reinforcing rods R can then be properly positioned with respect to the dam means 125, 127 and the rail means 137, 139, 141. Flowable, unset concrete or the like is then cast or poured between the first mold faces 41, 73 of the first and second mold means 39, 71; between the first mold face 105 of the third mold means 103 and the second mold faces 43, 75 of the first and second mold means 39,

71; and on top of the third mold faces 45, 77 of the first and second mold means 39, 71 and the second mold face 107 of the third mold means 103. The concrete or the like between the first mold faces 41, 73 will form the stem S of the tee being cast. The concrete or the like between the first mold face 105 and the second mold faces 43, 75 will form the diaphragm D of the tee being cast. The concrete or the like on top of the third mold faces 45, 77 and the second mold face 107 will form the flange F of the tee being cast. The top of the flange F of the tee can be finished in any manner apparent to those skilled in the art. After the concrete or the like has solidified to the point where it can be safely handled, the second and third mold means 71, 103 are moved to the opened position to thereby allow the cast tee to be easily removed from the molding apparatus 11.

Although the invention has been described and illustrated with respect to preferred embodiments thereof, it is not to be so limited since changes and modifications may be made therein which are within the full intended scope of the invention.

I claim:

1. Portable concrete molding apparatus comprising:

(a) a bed;

(b) a first mold means for being fixedly attached to said bed; said first mold means including a first mold face having a forward edge, a rearward edge, a top edge and a bottom edge; said first mold means including a second mold face having an outer side edge, an inner side edge, a top edge and a bottom edge; said first and second mold faces being substantially normal to one another with said rearward edge of said first mold face being conterminous with said inner side edge of said second mold face;

(c) a second mold means for being movably attached to said bed; said second mold means including a first mold face having a forward edge, a rearward edge, a top edge and a bottom edge; said second mold means including a second mold face having an outer side edge, an inner side edge, a top edge and a bottom edge; said first and second mold faces being substantially normal to one another with said rearward edge of said first mold face being conterminous with said inner side edge of said second mold face; said first mold faces of said first and second mold means being substantially the same shape and size and being located substantially directly opposite one another a spaced-apart distance; and (d) a third mold means for being movably attached to said bed; said third mold means including a first mold face having a first side edge, a second side edge, a top edge and a bottom edge; said first mold face of said third mold means being substantially the same shape and size as the combined spaced-apart shape and size of said second mold faces of said first and second mold means and being located substantially directly opposite thereof a spaced-apart distance.

2. The molding apparatus of claim 1 in which said first mold means includes a third mold face having a forward edge, a rearward edge, an outer side edge and an inner side edge; said third mold face of said first mold means being substantially normal to said first and second mold faces thereof; said inner side edge of said third mold face of said first mold means being conterminous with said top edge of said first mold face thereof; said rearward edge of said third mold face of said first mold means being conterminous with said top edge of said second mold face thereof; in which said second mold means includes a third mold face having a forward edge, a rearward edge, an outer side edge and an inner side edge; said third mold face of said second mold means being substantially normal to said first and second mold faces thereof, said inner side edge of said third mold face of said second mold means being conterminous with said top edge of said first mold face thereof, said rearward edge of said third mold face of said second mold means being conterminous with said top edge of said second mold face thereof; and in which said third mold means includes a second mold face having a forward edge, a rearward edge, a first side edge and a second side edge; said first and second mold faces of said third mold means being substantially normal to one another with said forward edge of said second mold face being conterminous with said top edge of said first mold face.

3. The molding apparatus of claim 2 in which is included wheel means for movably supporting said bed.

4. The molding apparatus of claim 3 in which is included a first dam means for extending between said first side edge of said first mold face of said third mold means and said outer side edge of said second mold face of said first mold means; in which is included a second dam means for extending between said second side edge of said first mold face of said third mold means and said outer side edge of said second mold face of said second mold means; and in which is included a third dam means for extending between said forward edge of said first mold face of said first mold means and said forward edge of said first mold face of said second mold means.

5. The molding apparatus of claim 4 in which said first mold means includes rail means for extending upward from said forward edge and said outer side edge of said third mold face thereof; in which said second mold means includes rail means for extending upward from said forward edge and said outer side edge of said third mold face thereof; and in which said third mold means includes rail means for extending upward from said rearward edge, said first side edge and said second side edge of said second mold face thereof.

6. The molding apparatus of claim 5 in which is included first transit means for allowing said second mold means to move between open and closed positions, and in which is included second transit means for allowing said third mold means to move between open and closed positions.

7. The molding apparatus of claim 6 in which said first transit means includes a first slide means for being attached to said bed of said trailer, includes a second slide means for being attached to said second mold means and for coactingly engaging said first slide means thereof, and includes actuator means for causing said second mold means to move between the open and closed positions; and in which said second transit means includes a first slide means for being attached to said bed of said trailer, includes a second slide means for being attached to said third mold means and for coactingly engaging said first slide means thereof, and includes actuator means for causing said third mold means to move between the open and closed positions.

8. The molding apparatus of claim 7 in which said first slide means of said first and second transit means includes a plurality of elongated slide members being substantially T-shaped in cross section, and in which said second slide means of said first and second transit means includes a plurality of elongated slide members being substantially inverted T-shaped in cross section.

9. The molding apparatus of claim 8 in which said second slide means of said first and second transit means includes hook clip means attached to each elongated slide member thereof for aligning and holding each elongated slide member of said second slide means of said first and second transit means with respect to a coacting one of said elongated slide members of said first slide means of said first and second transit means.

10. The molding apparatus of claim 9 in which said elongated slide members of said first and second transit means slope downward and outward with respect to said first mold means to cause said second and third mold means to move downward and outward with respect to said first mold means which said second and third mold means are moved from the closed position to the open position.

11. The molding apparatus of claim 10 in which said elongated slide members of said first transit means slope forward with respect to said third mold means to cause said second mold means to move forward with respect to said third mold means when said second mold means is moved from the closed position to the open position.

12. The molding apparatus of claim 6 in which said first transit means includes a plurality of roller means for being attached to said second mold means, includes a plurality of roller follower means for being attached to said bed and for coactingly engaging said roller means, and includes actuator means for causing said second mold means to move between the open and closed positions; and in which said second transit means includes a plurality of roller means for being attached to said third mold means, includes a plurality of roller follower means for being attached to said bed and for coactingly engaging said roller means, and includes actuator means for causing said third mold means to move between the open and closed positions.

13. The molding apparatus of claim 12 in which said each roller follower means of said first and second transit means has an elongated slot therein for receiving a portion of the coating roller means and for aligning and holding said roller means with respect to said roller follower means.

14. The molding apparatus of claim 13 in which said slot of each of said roller follower means extends downwardly and outwardly with respect to said first mold means to cause said second and third mold means to move downward and outward with respect to said first mold means when said second and third mold means are moved from the closed position to the open position.

15. The molding apparatus of claim 14 in which said slot of each of said roller follower means of said first transit means extends forwardly with respect to said third mold means to cause said second mold means to move forward with respect to said third mold means when said second mold means is moved from the closed to the open position.

16. The molding apparatus of claim 14 in which said slot of each of said roller follower means has a first portion and a second portion, said first and second portions of each of said slots having substantially identical slopes.

17. The molding apparatus of claim 11 in which said actutor means of said first and second transit means includes a plurality of jack screw means positioned at spaced apart locations along the length of said second and third mold means, and in which is included a motor means for selectively driving said plurality of jack screw means.

18. The molding apparatus of claim 17 in which is included a first adjustment means for allowing said first mold face of said first mold means to be selectively moved inward and outward, in which is included a second adjustment means for allowing said first mold face of said second mold means to be selectively moved inward and outward, and in which is included third adjustment means for allowing said first mold face of said third mold means to be selectively moved forward and rearward.

19. The molding apparatus of claim 18 in which said first mold means includes an adjustable cove means along said rearward edge and said inner side edge of said third mold face thereof, in which said second mold means includes an adjustable cove means along said rearward edge and said inner side edge of said third mold face thereof, and in which said third mold means includes an adjustable cove means along said forward edge of said second mold face thereof; each of said cove means of said first, second and third mold means including attachment means positioned along the respective said mold faces of said first, second and third mold means and including form means for being removably coupled to said attachment means.

20. The molding apparatus of claim 19 in which is included a plurality of movable support means located at spaced distances on said bed for selectively extending between said bed and the support surface and for leveling and supporting said bed.

21. The molding apparatus of claim 20 in which is included an interconnected series of level gauge means attached to said bed for indicating the degree of level of said bed.

22. The molding apparatus of claim 21 in which each of said first, second and third dam means includes first and second elongated and coacting flange members, said first flange member having a plurality of spaced, outwardly opening notches for allowing reinforcing rods to extend therethrough, said second flange member coacting with said first flange member to substantially block all of said notches of said first flange member except the portions thereof which the reinforcing rods extend through.

23. The molding apparatus of claim 22 in which said notches of said first flange members of said dam means are substantially V-shaped.

24. The molding apparatus of claim 22 in which said rail means of said first, second and third mold means includes an upwardly directed elongated member and a coacting elongated cap member, said flange member having a plurality of spaced, upwardly opening notches for allowing reinforcing rods to extend therethrough, said cap member coacting with said flange member to substantially block all of said notches except the portions thereof which the reinforcing rods extend through.

25. The molding apparatus of claim 24 in which said notches of said flange members are substantially V-shaped.

26. The molding apparatus of claim 24 in which is included a heating means for selectively heating said first, second and third mold means.

27. The molding apparatus of claim 26 in which said first, second and third mold means includes structural means for substantially enclosing said mold faces thereof and for creating substantially enclosed cavity adjacent said mold faces thereof; and in which said heating means includes forced air means for forcing heated air into said cacity of said first, second and third mold means to evenly heat said mold means.

28. The molding apparatus of claim 27 in which is included vibrator means for selectively vibrating said first, second and third mold means.

29. The molding apparatus of claim 28 in which said vibrator means includes a plurality of eccentric-weight vibrator members coupled to said mold faces of said first, second and thid mold means.

30. The molding apparatus of claim 28 in which is included walkway for surrounding said first, second and third mold means.

31. The molding apparatus of claim 30 in which is included safety rail means for surrounding said walkway means.

32. The molding apparatus of claim 31 in which is included light means about said walkway means.

33. The molding apparatus of claim 30 in which said walkway means includes a plurality of support brackets, said support brackets being rotatable to a closed position against the sicdes of said mold means.

* * * * *